US007750866B2

(12) United States Patent
Rambeau et al.

(10) Patent No.: US 7,750,866 B2
(45) Date of Patent: Jul. 6, 2010

(54) DIVERSITY ANTENNA ASSEMBLY FOR WIRELESS COMMUNICATION EQUIPMENT

(75) Inventors: Vincent Rambeau, Cormelles le Royal (FR); Jan Van Sinderen, Liempde (NL); Johannes H. A. Brekelmans, Nederweert (NL); Marc G. M Notten, Elsloo (NL)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 11/915,812

(22) PCT Filed: May 16, 2006

(86) PCT No.: PCT/IB2006/051527

§ 371 (c)(1), (2), (4) Date: Apr. 8, 2009

(87) PCT Pub. No.: WO2006/129210

PCT Pub. Date: Dec. 7, 2006

(65) Prior Publication Data

US 2009/0195472 A1 Aug. 6, 2009

(30) Foreign Application Priority Data

May 30, 2005 (EP) ..... 05300431

(51) Int. Cl.
*H01Q 7/00* (2006.01)
*H01Q 9/16* (2006.01)
*H01Q 3/24* (2006.01)

(52) U.S. Cl. ..... 343/866; 343/793; 343/876

(58) Field of Classification Search ..... 343/793, 343/846, 866, 876, 893
See application file for complete search history.

(56) References Cited

U.S. PATENT DOCUMENTS

| | | | | |
|---|---|---|---|---|
| 1,589,344 | A | 6/1926 | Akers | |
| H1571 | H | 8/1996 | Hansen et al. | |
| 6,909,401 | B2 * | 6/2005 | Rutfors et al. | 343/702 |
| 7,212,164 | B2 * | 5/2007 | Miyano et al. | 343/702 |
| 2006/0114159 | A1 * | 6/2006 | Yoshikawa et al. | 343/702 |

FOREIGN PATENT DOCUMENTS

WO 9812773 A1 3/1998

* cited by examiner

*Primary Examiner*—Shih-Chao Chen

(57) ABSTRACT

An antenna assembly for wireless communication equipment comprises an antenna structure comprising at least a loop type antenna arranged to deliver a first current when it is used in a balanced mode and/or a second current when it is used in an unbalanced mode with respect to a ground plane from received radio signals, and current extraction device coupled to the antenna structure and arranged to be placed in at least a first state in which the current extraction device delivers the first or second current and a second state in which the current extraction device simultaneously delivers the first and second currents either separately or mixed together.

10 Claims, 5 Drawing Sheets

DIVERSITY ANTENNA ASSEMBLY FOR WIRELESS COMMUNICATION EQUIPMENT

FIELD OF THE INVENTION

The present invention relates to the domain of antennas, and more precisely to the antenna assemblies used in wireless communication equipment (receivers and/or transmitters) having a small size compared to the wavelength, such as mobile phones or personal digital assistants (PDAs) or laptops or portable AM/FM receivers or else radio navigation equipment (for instance GPS).

The antenna assemblies, which are used in most types of wireless communication equipment, comprise either an electric dipole antenna or a magnetic dipole (also named loop antenna).

BACKGROUND OF THE INVENTION

As is known by the man skilled in the art an electric dipole antenna is generally intended to receive the horizontal polarization (vertical polarization respectively when it is rotated by 90°) of transmitted radio signals when a magnetic dipole or a loop antenna is generally intended to receive the vertical (horizontal) polarization respectively of transmitted radio signals.

When wireless communication equipment is moving, the surroundings introduce what is usually named multiple signal paths (or multipaths).

For certain locations, these multiple signal paths induce a signal dropping, which involves a signal-to-noise ratio (SNR) lower than a chosen threshold. This situation frequently appears at several "fading" locations inside a room with classical dimensions. In these fading locations when the electric field is minimum, the magnetic field is generally maximum, and conversely.

To avoid this fading problem it has been proposed to introduce diversity in the antenna assembly. Such a diversity may be obtained by means of a combination of two antennas with different types.

Such a combination usually requires the antennas to be interspaced by a distance which is generally equal to $\lambda/4$, where $\lambda$ is the signal wavelength. For small wireless communication equipment (such as mobile phones) with relatively low signal frequencies (such as the ones used in television transmissions), the requirement as regards the distance between the antennas cannot be respected.

Antenna structures such as PIFAs (Planar Inverted-F Antennas) or folded monopole or else loop antenna coupled to a ground plane have also been proposed. In these antenna structures a balanced current (resulting from a differential signal at the antenna entrance) and an unbalanced current (resulting from a common voltage between the antenna and the ground plane) are mixed (or superposed) together. In certain cases this current mixing is of interest, but for the purpose of diversity it would be preferable to extract the balanced and/or the unbalanced mode, as these modes have different behaviors towards fading.

So, the object of this invention is to improve the situation.

SUMMARY OF THE INVENTION

For this purpose, the invention provides an antenna assembly, for wireless communication equipment, comprising:

an antenna structure comprising at least an antenna of the loop type (i.e. a loop antenna or a slot antenna), hereafter named loop type antenna, used in a balanced mode to deliver a first current and/or used in an unbalanced mode with respect to a ground plane to deliver a second current from received radio signals, and current extraction means coupled to the antenna structure and arranged to be placed in at least a first state in which they deliver the first or second current and a second state in which they simultaneously deliver the first and second currents either separately or mixed together.

The balanced mode is sensitive to the magnetic field (H) and may be obtained by means of a magnetic dipole (such as an antenna of the loop type), whereas the unbalanced mode is sensitive to the electric field (E) and may be obtained by means of an electric dipole (such as an antenna of the whip type).

The antenna assembly according to the invention may include additional characteristics considered separately or combined, and notably:

in a first family of embodiments i) the loop type antenna may be connected to a ground plane and arranged to deliver the first current (balanced mode), ii) the antenna structure may further comprise an electric dipole antenna arranged to deliver the second current (unbalanced mode), and iii) the current extraction means may comprise a first amplification means (having first and second inputs coupled to first and second terminations respectively of the loop type antenna and an output to deliver the first current) and a second amplification means (having first and second inputs coupled to a termination of the electric dipole antenna and to the ground plane respectively and an output to deliver the second current);

in a second family of embodiments the current extraction means may comprise i) a switching means comprising first and second terminations, coupled to the ground plane and to a first termination of the loop type antenna respectively, and arranged to be placed in an opened state (defining the first state) in order to disconnect the loop type antenna from a ground plane and in a closed state (defining the second state) in order to connect the loop type antenna to this ground plane, and ii) amplification means having first and second inputs coupled to a second termination of the loop type antenna and to the ground plane respectively and an output to deliver either the first and second currents mixed together when the switching means is in its closed state or the second current when the switching means is in its opened state;

the antenna structure may further comprise an electric dipole antenna comprising a termination connected to the first input of the switching means and arranged to deliver the second current (unbalanced mode);

in a third family of embodiments the current extraction means may comprise a tuning circuit i) arranged to be placed in a balanced state defining the first state and in an unbalanced state defining the second state, and ii) comprising first, second and third terminals coupled to first and second terminations of the loop type antenna and to the ground plane respectively and a first output arranged to deliver either the first current when the tuning circuit is in its balanced state or the first and second currents mixed together when the tuning circuit is in its unbalanced state;

the tuning circuit may comprise i) a first variable capacitive means coupled to the first and third terminals, ii) a second variable capacitive means coupled to the second and third terminals, and iii) a first amplification means having first and second inputs coupled to the first or second terminal and to the third terminal respectively and an output defining the first output to deliver either the first current when the tuning circuit is in its balanced state or the first and second currents mixed together when the tuning circuit is in its unbalanced state;

the tuning circuit may further comprise a second amplification means having first and second inputs coupled to the third terminal and to the ground plane respectively and an output defining a second output of the tuning circuit, arranged to deliver the second current whatever the tuning circuit state;

the antenna structure may further comprise an electric dipole antenna comprising a termination connected to the loop type antenna at a location where a zero potential exists when the tuning circuit is in its balanced state (in order to increase the effect of the unbalanced mode, and so increase its efficiency);

in a variant the loop type antenna may comprise i) a first part made of a coaxial cable comprising a central conductor (having a first termination connected to the first terminal of the tuning circuit and a second termination) and a peripheral conductor (having a first termination connected to the second terminal of the tuning circuit and a second termination), and ii) a second part made of a conductor having a first termination and a second termination connected to the peripheral conductor in the vicinity of its first termination. Moreover, the tuning circuit comprises i) a variable capacitive means comprising a first part connected to the second termination of the central conductor and to the first termination of the second part conductor, and a second part connected to the second termination of the peripheral conductor, ii) a first amplification means having first and second inputs coupled to the first termination of the central conductor and to the first termination respectively of the peripheral conductor and an output (defining the first output) in order to deliver the first current, and iii) a second amplification means having first and second inputs coupled to the first termination of the peripheral conductor and to the third terminal respectively and an output defining a tuning circuit second output in order to deliver the second current;

the antenna structure may further comprise an electric dipole antenna comprising a termination connected to the second termination of the peripheral conductor.

BRIEF DESCRIPTION OF THE DRAWINGS

Other features and advantages of the invention will become apparent on examining the detailed specifications hereafter and the appended drawings, wherein.

The appended drawings may not only serve to complete the invention, but also to contribute to its definition, if need be.

DESCRIPTION OF PREFERRED EMBODIMENTS

The invention aims at offering a diversity antenna assembly for wireless communication equipment having a small size compared to the wavelength.

In the following description it will be considered that the wireless communication equipment is a mobile phone, for instance a GSM or a DECT telephone. But the invention is not limited to this kind of equipment. It may be also a laptop or a PDA (Personal Digital Assistant) comprising a communication device, or a portable AM/FM receiver, or else radio navigation equipment (such as a GPS), for instance.

Figure 1A:
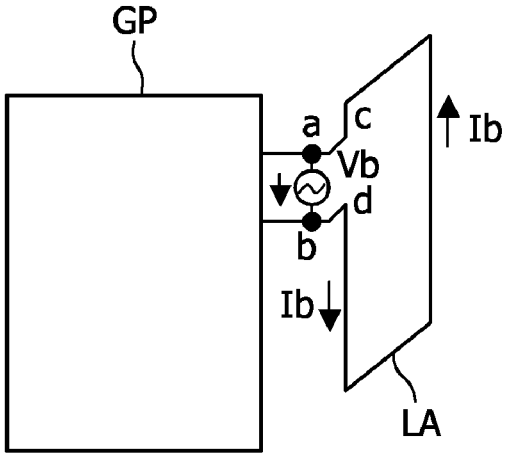
FIGS. 1A and 1B schematically illustrate the generation of the balanced and unbalanced currents in an antenna assembly comprising a loop antenna connected to a ground plane, FIG. 2 schematically illustrates a first example of embodiment of an antenna assembly according to the invention, FIG. 3 schematically illustrates a second example of embodiment of an antenna assembly according to the invention, FIG. 4 schematically illustrates a third example of embodiment of an antenna assembly according to the invention, FIG. 5 schematically illustrates a fourth example of embodiment of an antenna assembly according to the invention.
Figure 1B:
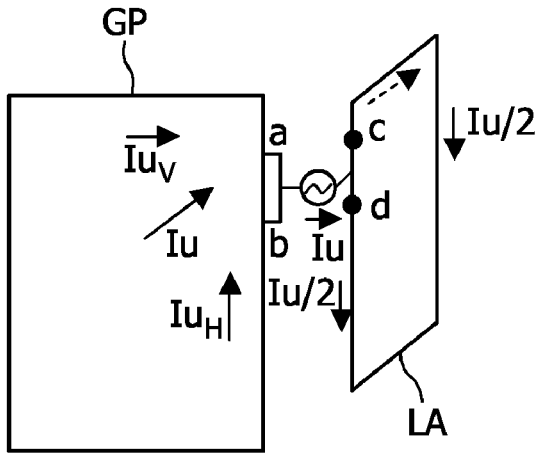

Reference is initially made to FIGS. 1A and 1B to briefly recall the generation mechanism of the balanced and unbalanced currents in an antenna assembly comprising a loop antenna LA connected to a ground plane GP, before describing examples of embodiment of antenna assemblies according to the invention. It is important to notice that the invention applies to any loop type antenna, i.e. to a loop antenna and to a slot antenna.

As mentioned in the introductory part, antenna structures like PIFAs, folded monopole or loop antenna LA with a ground plane GP are able to deliver a balanced current Ib and an unbalanced current Iu mixed (or superposed) together.

As illustrated in FIG. 1A, the balanced current Ib corresponds to a differential signal at the antenna entrance (between ac and bd), whereas, as illustrated in FIG. 1B, the unbalanced current Iu corresponds to a common voltage between the loop antenna LA and the ground plane GP (i.e. between ab and cd). The balanced current Ib is a current flowing in the loop from c to d, whereas the unbalanced current Iu is a current flowing in a single way from left to right, shared in two parts (equal to Iu/2) and decreasing to 0 at the end of the loop antenna LA (where it is connected to the ground plane GP). In other words, a loop circuit associated with a ground plane is an antenna where the balanced current (or signal) Ib and the unbalanced current (or signal) Iu are superposed.

An antenna assembly according to the invention comprises at least an antenna structure and current extraction means coupled to the antenna structure.

The antenna structure comprises at least a loop (type) antenna LA which can be used in a balanced mode to deliver a first (or balanced) current Ib and/or in an unbalanced mode with respect to a ground plane GP to deliver a second (or unbalanced) current Iu from received radio signals.

The current extraction means are arranged to be placed in at least a first state in which they deliver the first Ib or second current Iu and a second state in which they simultaneously deliver the first Ib and second Iu currents either separately or mixed together.

Figure 2:
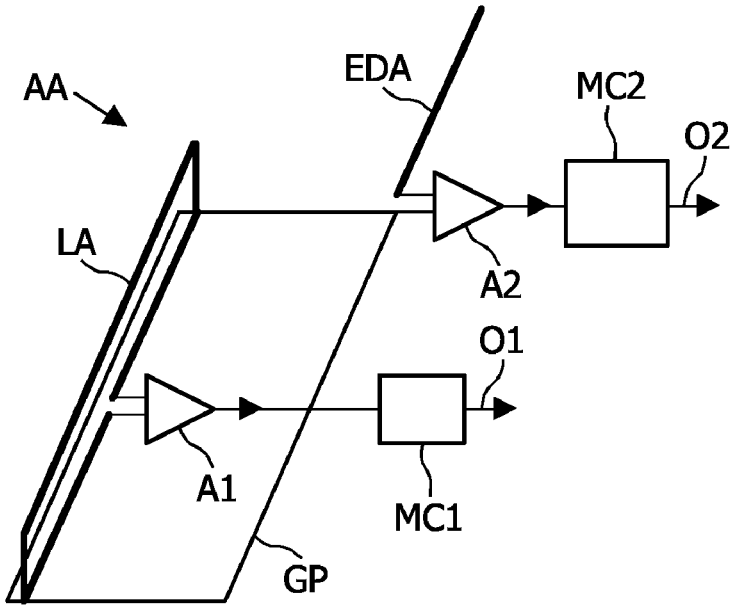

A first example of embodiment of an antenna assembly AA is illustrated in FIG. 2. In this first example, the antenna structure comprises a loop antenna LA and an electric dipole antenna EDA.

The loop antenna LA is connected to a ground plane GP and arranged to deliver the first (balanced) current Ib. It comprises first and second terminations coupled to a first and a second input respectively of a first amplification means A1 whose output is arranged to deliver the first current Ib.

The electric dipole antenna EDA is arranged to deliver the second (unbalanced) current Iu. It comprises a termination coupled to a first input of a second amplification means A2, which also comprises a second input connected to the ground plane GP and an output arranged to deliver the second current Iu.

The first and second amplification means A1, A2 constitute at least a part of the extraction means. They are preferably amplifiers of the low noise type (LNA). In this case and as illustrated in FIG. 2, each of the first and second amplification means A1, A2 is preferably coupled to a matching circuit MC1 or MC2 whose output defines a first or a second output O1, O2 of the extraction means.

If one considers that the loop antenna LA collects two electric field components (for instance $E_x$, $E_y$) and one magnetic field component (for instance $H_z$), then the electric dipole antenna EDA collects two magnetic field components (for instance $H_x$, $H_y$) and one electric field component (for instance $E_z$). Therefore, a combination of these two antennas LA and EDA, even close together, gives diversity when the signals are combined.

In this first example the extraction means may be placed in one of two states:

- a first state in which they deliver the first or second current Ib, Iu on the first or second output O1, O2, and
- a second state in which they simultaneously and separately deliver the first Ib and second Iu currents on the first and the second output O1, O2 respectively.

Figure 3:
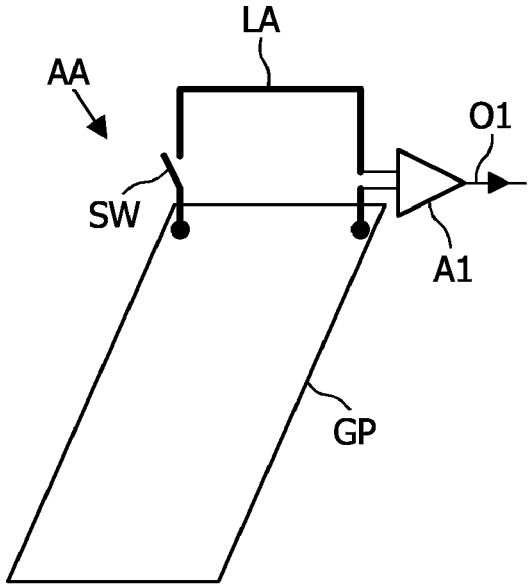

A second example of embodiment of an antenna assembly AA is illustrated in FIG. 3. In this second example, the antenna structure only comprises a loop antenna LA having first and second terminations.

The current extraction means comprises a switching means (such as a switch) SW and a first amplification means (such as an amplifier) A1.

The first amplifier A1 comprises first and second inputs coupled to the second termination of the loop antenna LA and to the ground plane GP respectively.

The switch SW comprises first and second terminations coupled to the ground plane GP and to the first termination of the loop antenna LA respectively. It can adopt two states:

- an opened state (defining the first state) in which it disconnects the loop antenna LA from the ground plane GP, and
- a closed state (defining the second state) in which it connects the loop antenna LA to the ground plane GP.

When the switch SW is in its closed state the loop antenna LA defines a closed circuit. Therefore, the first amplifier A1 delivers the first Ib and second Iu currents, mixed together, on its output, which defines the first output O1.

When the switch SW is in its opened state the loop antenna LA is interrupted. Therefore, only a part of the loop antenna LA associated with the ground plane GP works and acts as an electric dipole. So, the first amplifier A1 only delivers the second current Iu on its output, which defines the first output O1.

To receive the unbalanced mode efficiently, the switch SW needs to induce low ohmic losses compared to the radiation resistance of the loop antenna LA. Such a switch SW can be a mechanical switch, an EMR (ElectroMechanical Relay), or a MEMS (Micro ElectroMechanical System).

Figure 4:
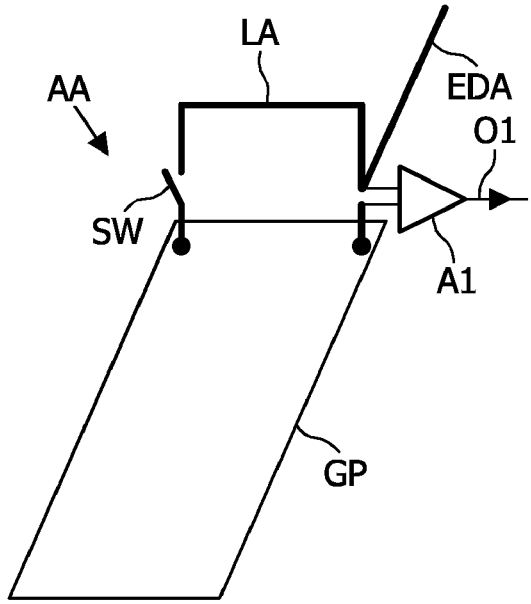

A third example of embodiment of an antenna assembly AA is illustrated in FIG. 4. This third example is a variant of the second example illustrated in FIG. 3. More precisely, this third example comprises any element of the second example and an additional electric dipole antenna EDA.

This electric dipole antenna EDA comprises a termination, which is preferably connected to the second termination of the loop antenna LA.

Disconnecting the loop antenna LA from the ground plane GP by means of the switch SW (in its opened state) makes the antenna structure equal to an electric dipole.

The working of this third example is identical to the one of the second example, but the collection of the unbalanced mode is improved due to the presence of the electric dipole antenna EDA, which makes the electric dipole longer.

Figure 5:
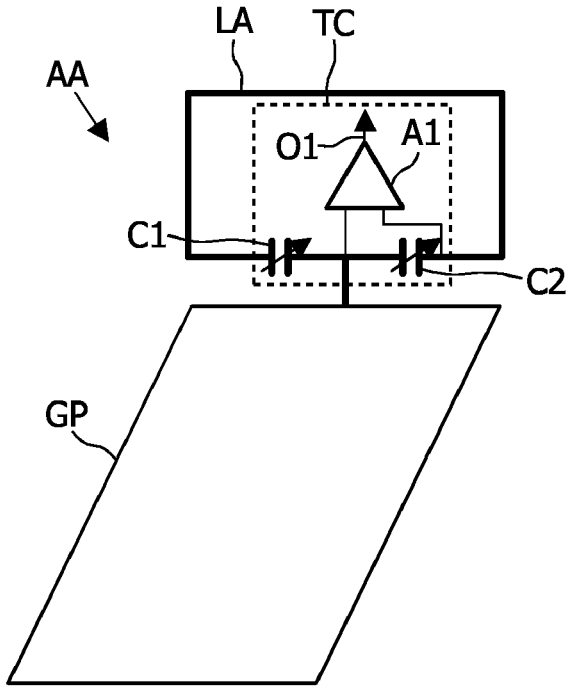

A fourth example of embodiment of an antenna assembly AA is illustrated in FIG. 5. In this fourth example, the antenna structure only comprises a loop antenna LA having first and second terminations.

The current extraction means comprise a tuning circuit TC arranged to be placed either in a balanced state defining the first state or in an unbalanced state defining the second state.

This tuning circuit TC schematically and mainly comprises first C1 and second C2 variable capacitive means and a first amplification means A1.

The first variable capacitive means C1 may be a tuning capacitor, for instance. It is coupled to first and third terminals of the extraction means, which are coupled to the first termination of the loop antenna LA and to the ground plane GP respectively.

The second variable capacitive means C2 may be a tuning capacitor, for instance. It is coupled to the second and the third terminal of the extraction means, which are coupled to the second termination of the loop antenna LA and to the ground plane GP respectively.

The first amplification means A1 may be an amplifier of the low noise type. It comprises first and second inputs, coupled to the second (or first) and the third terminal respectively of the extraction means, and an output defining the first output O1 of the extraction means.

Figure 6A:
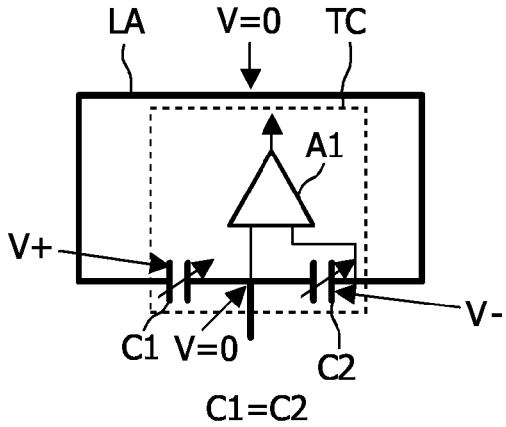
FIGS. 6A and 6B illustrate the electrical potentials in the tuning loop antenna and the tuning circuit of the antenna assembly shown in FIG. 5, when the tuning circuit is in its balanced and unbalanced states respectively, FIG. 7 schematically illustrates a fifth example of embodiment of an antenna assembly according to the invention, FIG. 8 schematically illustrates a sixth example of embodiment of an antenna assembly according to the invention.

The balanced state of the tuning circuit TC corresponds to a situation in which the capacitance of the first C1 and second C2 tuning capacitors are equal. In this case (illustrated in FIG. 6A) the tuning circuit TC defines a differential structure connected to the loop antenna LA. A connection to the electrical potential V=0 volt will not change the loop antenna LA. Therefore, the connection of the ground plane GP between the capacitors (through the third terminal), or the connection on top of the loop does not affect the reception of the balanced mode (Ib) with the loop antenna LA. Then the reception of the balanced mode (Ib) can be done either with a differential amplifier A1 between V+ and V− or with a single amplifier A1 between V+ and 0 (V 0) or V− and 0 (V 0), as illustrated in FIGS. 5 and 6A.

A first amplification means A1 with a high input impedance does not affect the capacitances of C1 and C2.

When the tuning circuit TC is in this balanced state the first output O1 of the first amplification means A1 delivers the first current Ib.

Figure 6B:
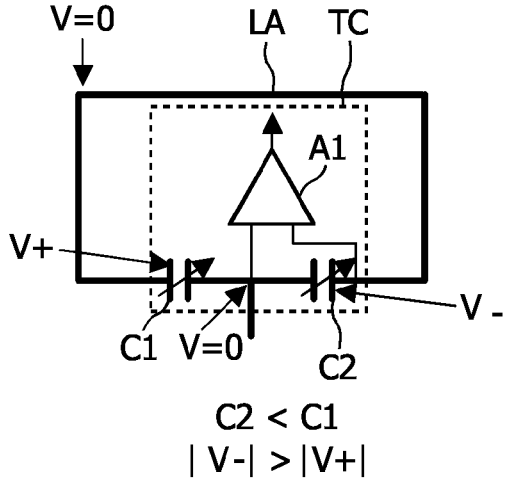

The unbalanced state of the tuning circuit TC corresponds to a situation in which the capacitance of the first C1 and second C2 tuning capacitors are different from each other. This case is illustrated in FIG. 6B.

For instance the capacitance of C2 is smaller than the one of C1 and |V−|>|V+|. The extreme situation appears when the capacitance of one of the first and second tuning capacitors C1, C2 is very small compared to the other one. This is equivalent to grounding a node of the loop antenna LA.

When the tuning circuit TC is in this unbalanced state the first output O1 of the first amplification means A1 delivers the first Ib and second Iu currents mixed (or superposed) together.

In the above described second to fourth examples of embodiment the antenna assembly AA is not able to deliver simultaneously and separately both the balanced and unbalanced currents. This results from the fact that the loop antenna LA is always connected to the ground plane GP through the third terminal of the tuning circuit TC. But other examples of embodiment, which will be described hereafter, allow to deliver simultaneously the balanced and unbalanced currents both separately or mixed together.

Figure 7:
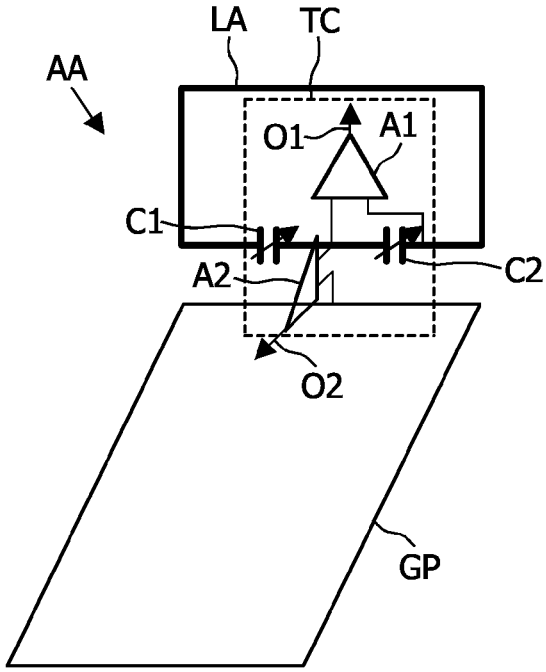

A fifth example of embodiment of an antenna assembly AA is illustrated in FIG. 7. This fifth example is a variant of the fourth example illustrated in FIGS. 5 and 6. More precisely, this fifth example comprises any element of the fourth example and a second amplification means A2, which is inserted between the third terminal of the tuning circuit TC and the ground plane GP.

The second amplification means A2 comprises first and second inputs, coupled to the third terminal of the tuning circuit TC and to the ground plane GP respectively, and an output defining a second output O2 of the tuning circuit TC. This second amplification means A2 may be an amplifier of the low noise type.

When the tuning circuit TC is in its balanced state, previously defined with reference to FIGS. 5 and 6A and corresponding to equal capacitances (C) of C1 and C2, the first amplifier A1 only delivers the first (balanced) current Ib. In effect, the second amplifier A2 being connected to a 0 electrical potential (V=0) through its first input it does not affect the balanced mode. Moreover, the second amplifier A2 seeing the ground plane GP on its second input and a wire in series with a capacitor C/2 on its first input (where C is the capacitance of C1 and C2 in the balanced state), it then delivers the unbalanced current Iu on its output O2.

Figure 8:
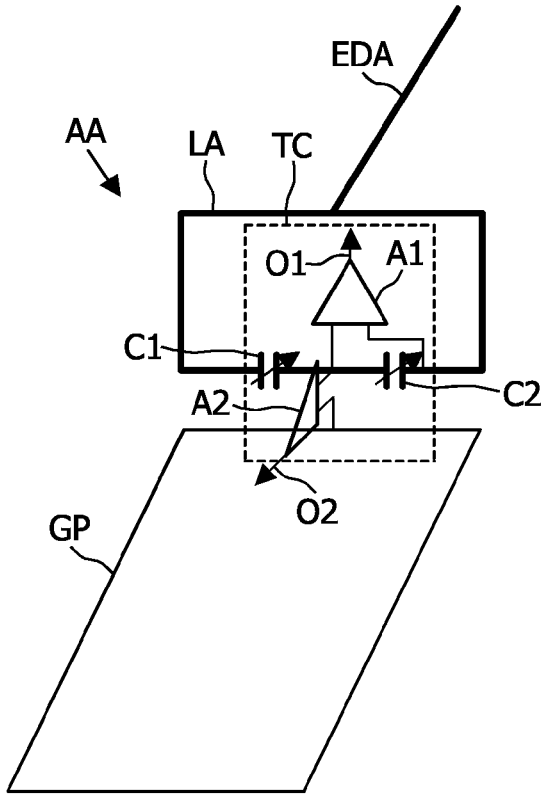

A sixth example of embodiment of an antenna assembly AA is illustrated in FIG. 8. This sixth example is a variant of the fifth example illustrated in FIG. 7. More precisely, this sixth example comprises each element of the fifth example and an additional electric dipole antenna EDA.

This electric dipole antenna EDA comprises a termination which is connected to a part of the loop antenna LA where a 0 electrical potential (V=0) exists when the tuning circuit TC is in its balanced state. With such an arrangement the balanced mode is not changed.

The working of this sixth example is identical to the one of the fifth example, but the extraction of the unbalanced mode is improved due to the presence of the electric dipole antenna EDA.

Figure 9:
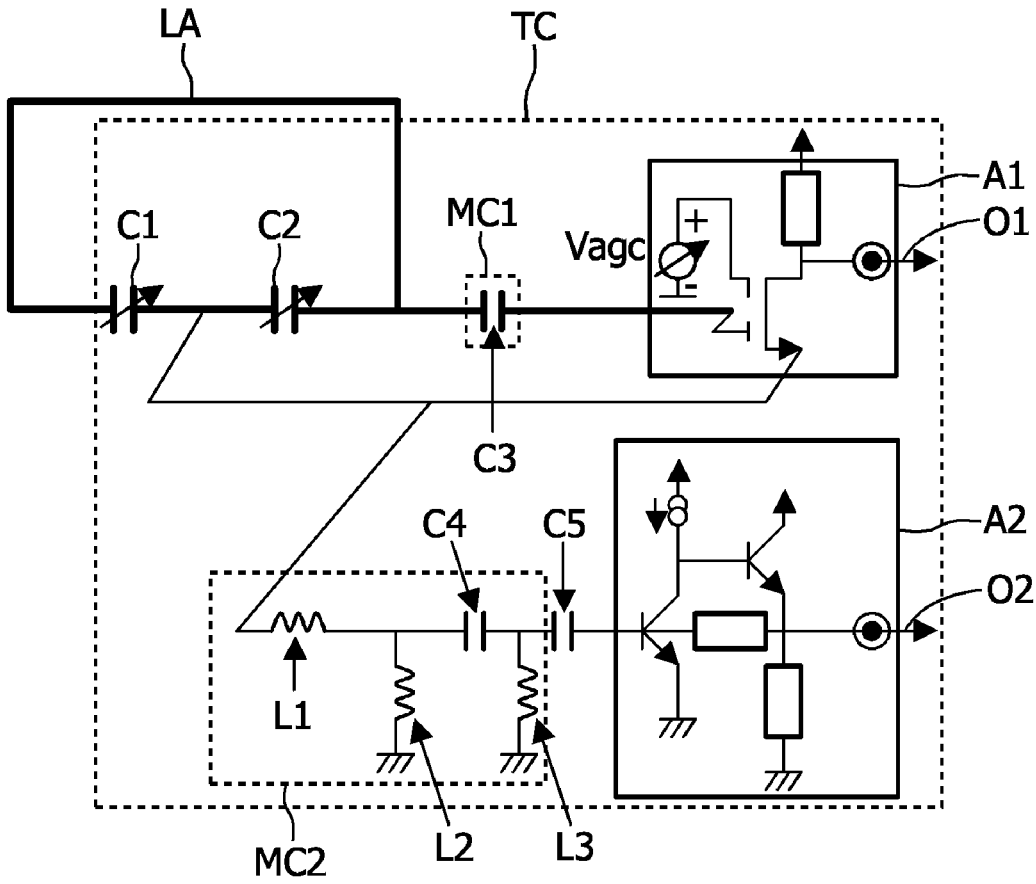
FIG. 9 illustrates a detailed example of tuning circuit intended for the antenna assemblies shown in FIGS. 7 and 8, FIG. 10 schematically illustrates an eighth example of embodiment of an antenna assembly according to the invention, and FIG. 11 schematically illustrates a ninth example of embodiment of an antenna assembly according to the invention.

A detailed example of a tuning circuit TC intended for the antenna assemblies shown in FIGS. 7 and 8 is illustrated in FIG. 9.

In this example the tuning circuit TC comprises:

the first C1 and second C2 tuning capacitors, a first matching circuit MC1 connected in series to the second terminal of the second capacitor C2 and comprising a third capacitor C3 having a capacitance approximately equal to 0.5 pF, for instance, the first amplification means A1 connected in series to the first matching circuit MC1, and to the third terminal located between the first C1 and second C2 tuning capacitors. This first amplification means A1 is preferably a high ohmic low noise amplifier, such as the one referenced BF1202, for instance, a second matching circuit MC2 connected to the third terminal and to the ground plane GP and comprising for instance a fourth capacitor C4 having a capacitance approximately equal to 3 pF (for instance), and three inductors L1, L2 and L3 having inductances equal to for instance approximately 13 nH, 16 nH and 20 nH respectively, and the second amplification means A2 connected in series to the second matching circuit MC1, through a fifth capacitor C5 (having a capacitance approximately equal to 1 nF, for instance), and to the ground plane GP. This second amplification means A2 is preferably a low ohmic low noise amplifier.

The above mentioned values of capacitances and inductances are only given as a non-limitative example. Many other combinations of values may be envisaged depending on the chosen application. Moreover, other types of matching circuit may be envisaged.

Figure 10:
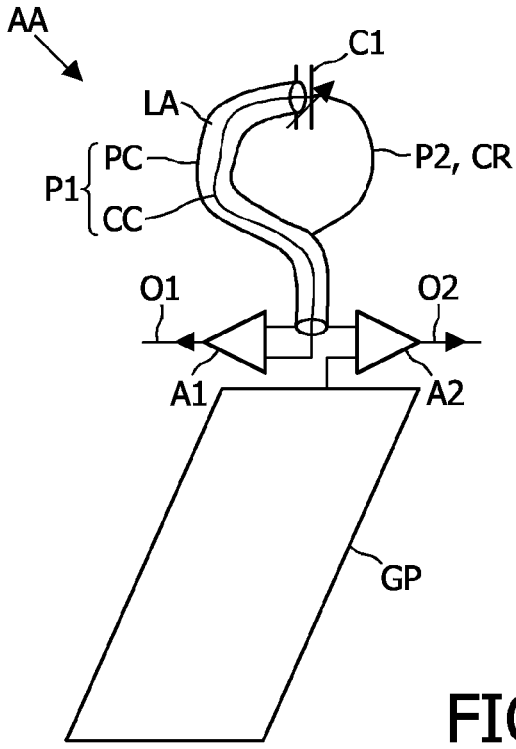

A seventh example of embodiment of an antenna assembly AA is illustrated in FIG. 10. In this seventh example, the antenna structure only comprises a loop antenna LA made of two parts P1 and P2.

The current extraction means comprises a tuning circuit TC comprising a variable capacitor means C1 and first A1 and second A2 amplification means.

The first amplification means A1 is preferably a differential low noise amplifier having first and second inputs, defining the first and second terminals respectively of the tuning circuit TC, and an output defining the first output O1 of the tuning circuit TC.

The second amplification means A2 is preferably a single low noise amplifier having first and second inputs, defining the third and second terminals respectively of the tuning circuit TC, and an output defining the second output O2 of the tuning circuit TC. The third terminal of the tuning circuit TC, and therefore the first input of the second amplification means A2, are connected to the ground plane GP.

The first part P1 of the loop antenna LA comprises a coaxial cable defining approximately half of the loop. This coaxial cable P1 comprises classically a central conductor CC surrounded by a peripheral conductor PC.

The central conductor CC comprises a first termination connected to the first terminal of the tuning circuit TC and a second termination connected to a first (right) part of the variable capacitor means C1.

The peripheral conductor PC comprises a first termination connected to the second terminal of the tuning circuit TC (and therefore to the second input of the first A1 and second A2 amplifiers) and a second termination connected to a second (left) part of the variable capacitor means C1.

The second part of the loop antenna LA comprises a conductor CR defining approximately the second half of the loop. This conductor CR comprises a first termination connected to the first (right) part of the variable capacitor means C1 and a second termination connected to the peripheral conductor PC in the vicinity of its first termination.

The tuning circuit TC enables to tune the loop antenna LA to a chosen frequency.

Whatever the state of the tuning circuit TC, the first amplifier A1 delivers the first current Ib on its (first) output O1, whereas the second amplifier A2 delivers the second current Iu on its (second) output O2.

Contrary to the fifth and sixth examples of embodiment in which the second amplifier A2 sees the tuning capacitance of the loop antenna LA, in this seventh example of embodiment the unbalanced mode is not affected by the tuning capacitance because the second amplifier A2 is connected to the first termination of the peripheral conductor PC. Therefore, the second amplifier A2 just sees a normal whip antenna defining an electric dipole.

Figure 11:
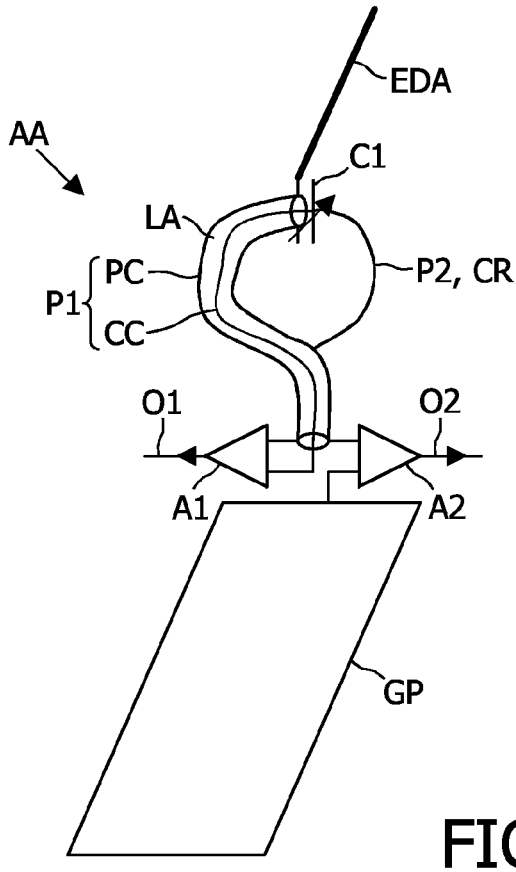

An eighth example of embodiment of an antenna assembly AA is illustrated in FIG. 11. This eighth example is a variant of the seventh example illustrated in FIG. 10. More precisely, this eighth example comprises any element of the seventh example and an additional electric dipole antenna EDA.

This electric dipole antenna EDA comprises a termination, which is connected to the second termination of the peripheral conductor PC. With such an arrangement the balanced mode is not changed.

The working of this eighth example is identical to the one of the seventh example. The electric dipole antenna EDA enables to improve the efficiency of the unbalanced mode, as explained before.

The invention is not limited to the embodiments of antenna assembly described above, only as examples, but it encompasses all alternative embodiments which may be considered by one skilled in the art within the scope of the claims hereafter.

The invention claimed is:

1. An antenna assembly for a wireless communication equipment, comprises:

an antenna structure comprising at least a loop type antenna arranged to deliver a first current when it is used in a balanced mode and/or a second current when it is used in an unbalanced mode with respect to a ground plane from received radio signals, and current extraction means coupled to said antenna structure and arranged to be placed in at least a first state in which the current extraction means delivers said first current or said second current and a second state in which the current extraction means simultaneously delivers said first and second currents either separately or mixed together.

2. The antenna assembly according to claim 1, characterized in that it comprises a ground plane, in that said antenna structure comprises:

said loop type antenna which is connected to said ground plane and arranged to deliver said first current and an electric dipole antenna arranged to deliver said second current, and in that said current extraction means comprises: a first amplification means including first and second inputs respectively coupled to first and second terminations of said loop type antenna and an output to deliver said first current, and a second amplification means including first and second inputs respectively coupled to a termination of said electric dipole antenna and to said ground plane and an output to deliver said second current.

3. The antenna assembly according to claim 1, characterized in that it comprises a ground plane, and in that said current extraction means comprises: a switching means including first and second terminations respectively coupled to said ground plane and to a first termination of said loop type antenna, and arranged to be placed in an opened state defining said first state to disconnect said loop type antenna from said ground plane and in a closed state defining said second state to connect said loop type antenna to said ground plane, amplification means including first and second inputs respectively coupled to a second termination of said loop type antenna and to said ground plane and an output to deliver either said first and second currents mixed together when said switching means is in its closed state or said second current when said switching means is in its opened state.

4. The antenna assembly according to claim 3, characterized in that said antenna structure also comprises an electric dipole antenna including a termination connected to the first input of said switching means and arranged to deliver said second current.

5. The antenna assembly according to claim 1, characterized in that it comprises a ground plane, and in that said current extraction means comprises a tuning circuit arranged to be placed in a balanced state defining said first state and in an unbalanced state defining said second state, and including first, second and third terminals respectively coupled to first and second terminations of said loop type antenna and to said ground plane, and a first output arranged to deliver either said first current when said tuning circuit is in its balanced state or said first and second currents mixed together when said tuning circuit is in its unbalanced state.

6. The antenna assembly according to claim 5, characterized in that said tuning circuit comprises: means for providing a first variable capacitance coupled to said first and third terminals, means for providing a second variable capacitance coupled to said second and third terminals, and a first amplification means including first and second inputs respectively coupled to said first or second terminal and to said third terminal and an output defining said first output to deliver either said first current when said tuning circuit is in its balanced state or said first and second currents mixed together when said tuning circuit is in its unbalanced state.

7. The antenna assembly according to claim 6, characterized in that said tuning circuit further comprises a second amplification means including first and second inputs respectively coupled to said third terminal and to said ground plane and an output defining a second output of said tuning circuit arranged to deliver said second current whatever the tuning circuit state.

8. The antenna assembly according to claim 7, characterized in that said antenna structure further comprises an electric dipole antenna including a termination connected to said loop type antenna at a location where a zero potential exists when said tuning circuit is in its balanced state.

9. The antenna assembly according to claim 5, characterized in that said loop type antenna comprises: a first part made of a coaxial cable including a central conductor, having a first termination connected to said first terminal and a second termination, and a peripheral conductor, having a first termination connected to said second terminal and a second termination, and a second part made of a conductor having a first termination and a second termination connected to said peripheral conductor in the vicinity of its first termination, and in that said tuning circuit comprises means for providing a variable capacitance including a first part, connected to said second termination of the central conductor and to said first termination of the second part conductor, and a second part connected to said second termination of the peripheral conductor, a first amplification means including first and second inputs respectively coupled to the first termination of said central conductor and to the first termination of said peripheral conductor and an output defining said first output to deliver said first current, and a second amplification means including first and second inputs respectively coupled to the first termination of said peripheral conductor and to said third terminal and an output defining a tuning circuit second output to deliver said second current.

10. The antenna assembly according to claim 9, characterized in that said antenna structure further comprises an electric dipole antenna including a termination connected to the second termination of said peripheral conductor.

* * * * *